US005636825A

United States Patent [19]

Pernas

[11] Patent Number: 5,636,825

[45] Date of Patent: Jun. 10, 1997

[54] HANGING DEVICE FOR FRAMES

[76] Inventor: Carlos Pernas, 100 SW. 125th Ave., Miami, Fla. 33184

[21] Appl. No.: 504,179

[22] Filed: Jul. 19, 1995

[51] Int. Cl.[6] ..... A47C 1/16

[52] U.S. Cl. ..... 248/489; 248/542; 248/544; 248/225.11; 248/225.21; 33/451

[58] Field of Search ..... 248/542, 544, 248/497, 498, 489, 477, 224.8, 225.4, 225.21; 33/613, 427, 451

[56] References Cited

U.S. PATENT DOCUMENTS

| | | | |
|---|---|---|---|
| 1,887,159 | 11/1932 | Knight | 248/489 |
| 2,530,892 | 11/1950 | Mayo | 248/498 |
| 3,982,719 | 9/1976 | Kilborne | 248/489 |
| 4,458,872 | 7/1984 | Couch | 248/497 |
| 4,458,873 | 7/1984 | Sutherland | 248/544 |
| 4,637,583 | 1/1987 | Babitz | 248/544 |
| 4,858,351 | 8/1989 | Sewell et al. | 248/497 X |
| 4,871,140 | 10/1989 | Hoskinson et al. | 248/497 X |
| 4,883,247 | 11/1989 | Crandall | 248/542 |
| 5,080,317 | 1/1992 | Letizia | 248/544 |

FOREIGN PATENT DOCUMENTS

| | | | |
|---|---|---|---|
| 2404411 | 4/1979 | France | 248/225.21 |

*Primary Examiner*—Ramon O. Ramirez
*Assistant Examiner*—Brian J. Hamilla
*Attorney, Agent, or Firm*—J. Sanchblima

[57] ABSTRACT

A hanging device for frames comprising a supporting assembly that is mounted to a vertical wall and a hanging assembly that is rigidly mounted to the back of a frame or other object to be hung. The hanging assembly has front and rear walls separated by an upper wall. The upper wall is removably mounted to the supporting assembly. The supporting assembly has a tubular shape with a rectangular cross-section. The supporting assembly includes a straight edge against which the straight upper wall of the hanging assembly rests ensuring that the frame will conform to the same orientation, typically horizontal, of the straight edge. A leveling device is mounted to the supporting assembly to facilitate the determination of the position of the latter.

2 Claims, 2 Drawing Sheets

FIG. 5
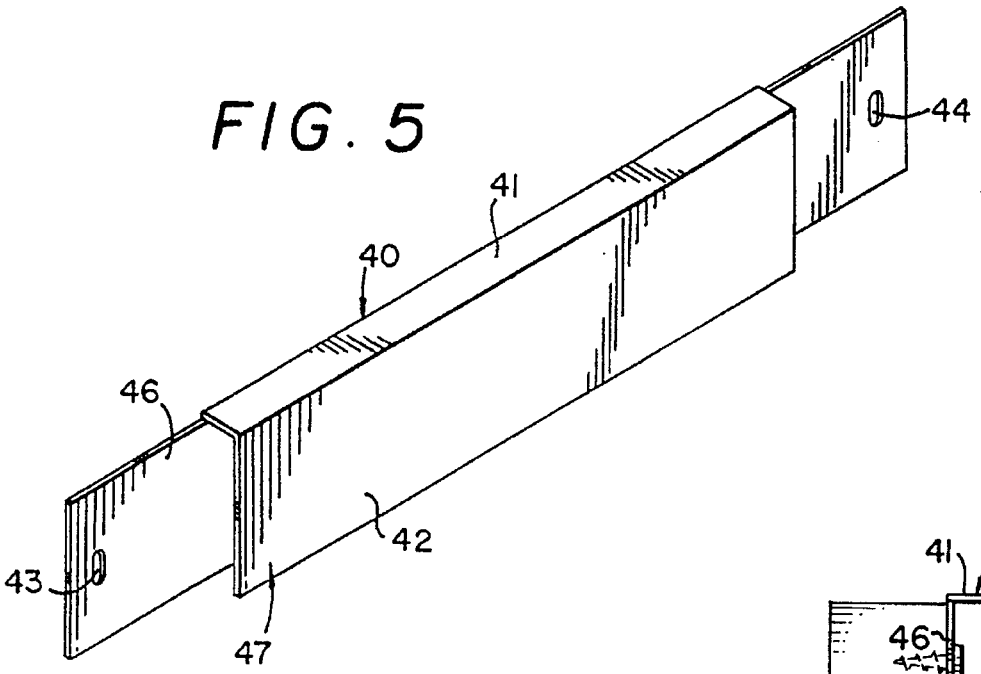
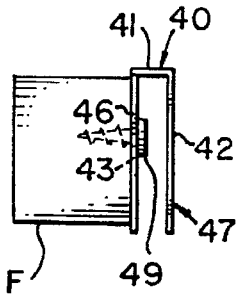
FIG. 6
FIG. 7
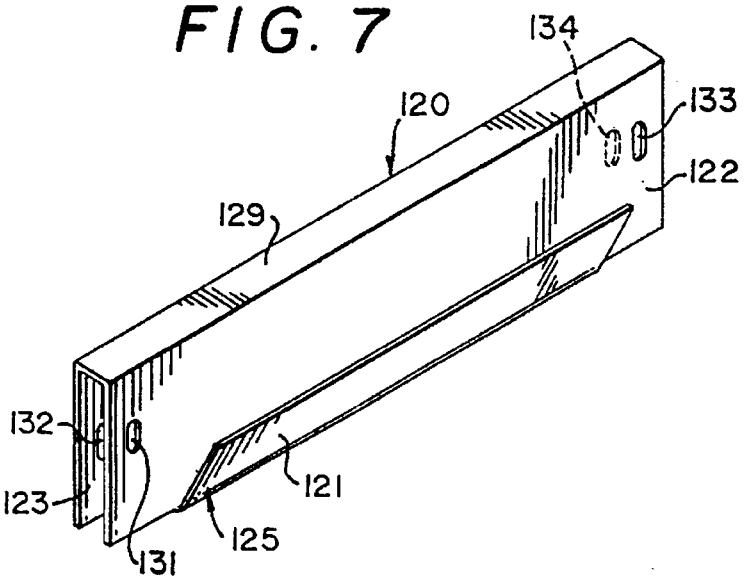
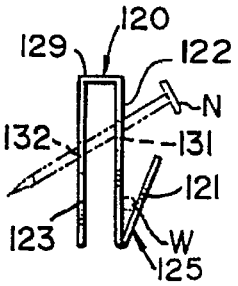
FIG. 8

HANGING DEVICE FOR FRAMES

II. BACKGROUND OF THE INVENTION

1. Field of the Invention

The present invention relates to a hanging device for frames.

2. Description of the Related Art

Hanging frames is typically accomplished with a wire or cord attached to the back of a frame which in turn is passed over a fastening device mounted to a wall or other vertical surface. Not infrequently, the frame is off balance or accidentally moved, and the result is a crooked frame. Properly mounting the fastening devices on a wall to ensure that the frame will stay straight is a task that is not easily within the reach of the average household dweller. The present invention provides a device for readily and properly mounting a frame to a wall, and keeping it straight permanently.

III. SUMMARY OF THE INVENTION

It is one of the main objects of the present invention to provide a device to hang frames on vertical surfaces resisting any accidental forces that would otherwise cause them to be crooked.

It is another object of this invention to provide a device that can be readily mounted to a wall and a frame without requiring extraordinary skills.

It is still another object of the present invention to provide a hanging device that includes a level that permits a user to hang a frame leveled with a horizontal plane.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 is an isometric view of the hanging member that is nailed to the back of a frame to be then hanged on the supporting member.

FIG. 6 shows an elevational side view of the hanging member illustrated in FIG. 5.

FIG. 7 is an isometric view of an alternate embodiment of the present invention using only one member for supporting and hanging a frame.

FIG. 8 is an elevational side view of the member shown in FIG. 7 having a nail passing the walls of this member.

V. DETAILED DESCRIPTION OF THE PREFERRED EMBODIMENT

Figure 1:
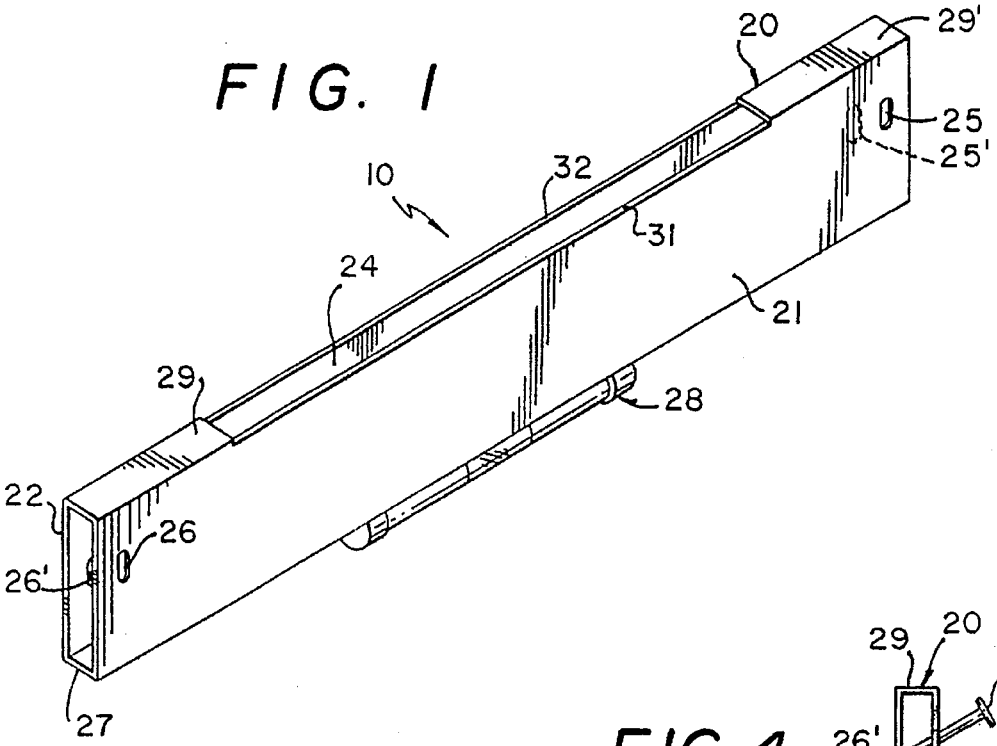
FIG. 1 represents an isometric view of the present invention, showing the supporting member that is nailed to the wall.
Figure 4:
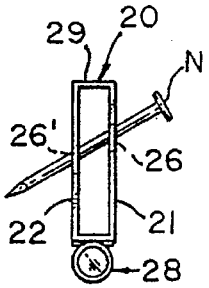
FIG. 4 is an elevational side view of the supporting member illustrated in the previous figures showing a nail passing through the walls of this member.
Figure 2:
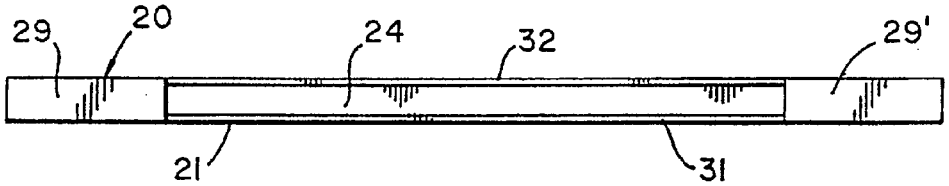
FIG. 2 shows a top view of the supporting member shown in the previous figure.
Figure 3:
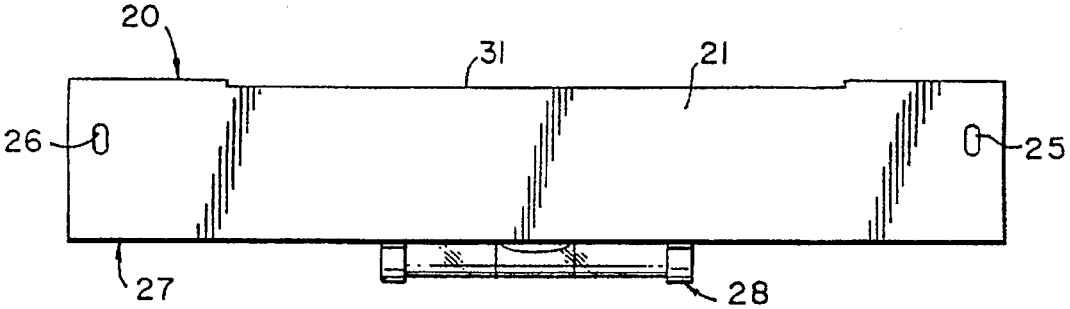
FIG. 3 illustrates an elevational front view of the supporting member shown in FIGS. 1 and 2.

Referring now to the drawings, where the present invention is generally referred to with numeral 10, it can be observed that it basically includes supporting assembly 20 and hanging assembly 40 or alternate hanging assembly 120.

Supporting assembly 20, in the preferred embodiment, has substantially an elongated tubular shape with a rectangular cross-section that includes front wall 21 with openings 25 and 26, rear wall 22 with openings 25' and 26' and longitudinal opening 24 located at the uppermost portion of supporting assembly 20. Walls 21 and 22 are kept at a spaced apart and parallel relationship with respect to each by bottom wall 27 and top walls 29 and 29'. Openings 25 and 25' are disposed in inclined alignment, so that nail N can pass through and enter into the wall enhancing its support. Openings 26 and 26' of walls 21 and 22, respectively, are similarly positioned for the same purpose, as best seen in FIGS. 1; 3 and 4. Supporting assembly 20, as shown in FIGS. 1; 3 and 4, includes leveling member 28 rigidly mounted to the underside of member 20, so that the latter, and in particular edges 31 and 32, can be readily leveled.

Hanging assembly 40, as shown in FIGS. 5 and 6, includes front wall 42 and rear wall 46 kept at a spaced apart and parallel relationship with respect to each other by upper wall 41. Openings 43 and 44 are located at the ends of wall 46, and are designed to permit a nail or screw 49 to go through and into the frame. Once assembly 40 is mounted to a frame F and supporting assembly 20 is mounted to a wall, assembly 40 is ready to be hanged to assembly 20 by inserting hook member 47 between walls 21 and 22. Hook member 47, in the preferred embodiment, includes upper wall 41 and front wall 42 disposed in perpendicular relationship to each other. Since edges 31 and 32 are straight, and the same is true for upper wall 41, the frame to which assembly 40 is mounted is also in alignment with edges 31 and 32, typically horizontal.

In FIGS. 7 and 8, an alternate embodiment for hanging assembly 120 for use with frames that include a cord or wire W is shown. Front wall 121 extends upwardly at an angle with respect to middle wall 122. Wall 122 is kept at a spaced apart and parallel relationship with respect to rear wall 123 by top wall 129. Hanging assembly 120 is removably mounted to supporting assembly 20 by inserting rear wall 123 between walls 21 and 22 of assembly 20. Cord or wire W is placed on hook 125 supporting a frame (not shown). Top wall 129, like upper wall 41, is straight and comes in cooperative aligned abutment with edges 31 and 32 of assembly 20.

Alternatively, hanging assembly 120 can also be mounted to a wall directly and act as a supporting assembly. Hanging assembly 120 includes openings 131 and 133 located on wall 122 and openings 132 and 134 located on wall 123. These openings are designed to permit nail N to go through and into a wall. A frame (not shown), with a cord or wire W attached to its back, is ready to be hanged to hook member 125 as best seen in FIG. 8. Hook member 125, in the alternate embodiment, is formed by front wall 121 and middle wall 122.

The foregoing description conveys the best understanding of the objectives and advantages of the present invention. Different embodiments may be made of the inventive concept of this invention. It is understood that all matter disclosed herein is to be interpreted merely as illustrative, and not in a limiting sense.

VI. CLAIMS

What is claimed is:

1. A device for hanging a frame to a vertical wall, comprising:

A) a supporting assembly having an elongated tubular shape with a rectangular cross-section and having a longitudinal opening defining a straight edge along substantially the entire length of said supporting assembly, and wherein said supporting assembly includes leveling means mounted thereon to allow a user to readily determine the position of said supporting assembly;

B) first means for fastening said supporting assembly to said vertical wall;

C) a hanging assembly having first, second and third elongated walls wherein said first and third walls are kept at a parallel, opposite and spaced apart relationship with respect to each other by said second wall which is adjacent to and perpendicularly mounted to said first and third walls and said third wall being removably and cooperatively receivable within said longitudinal opening so that said second wall comes in aligned contact with said straight edge and wherein said first wall is longer than said second and third walls; and D) second means for fastening said hanging assembly to said frame.

2. The device set forth in claim 1 wherein said supporting assembly includes a plurality of first openings that cooperate with said first fastening means and said first wall of said hanging assembly includes a plurality of second openings that cooperate with said second fastening means.

* * * * *